United States Patent [19]

Saito et al.

[11] 3,952,498

[45] Apr. 27, 1976

[54] AUTOMATIC BARREL WINDING MECHANISM

[75] Inventors: Mituo Saito; Kotaro Takahashi, both of Tokyo, Japan

[73] Assignee: Citizen Watch Co., Ltd., Tokyo, Japan

[22] Filed: Sept. 26, 1974

[21] Appl. No.: 509,401

[30] Foreign Application Priority Data

Sept. 28, 1973 Japan ..... 48-108972

[52] U.S. Cl. ..... 58/82 A

[51] Int. Cl.[2] ..... G04B 5/02

[58] Field of Search ..... 58/82 R, 82 A

[56] References Cited

UNITED STATES PATENTS 3,306,025 2/1967 Kocher ..... 58/82 R

*Primary Examiner*—George H. Miller, Jr.

*Attorney, Agent, or Firm*—Holman & Stern

[57] ABSTRACT

An automatic barrel winding mechanism of the unidirectional type in which the main feature resides in a substantially reduced torque ratio : 0.5 – 1.1 in combination with a substantially reduced reduction ratio : 1/60 – 1/126 of the barrel winding gear train for transmitting moton from the barrel-winding mass to the barrel.

3 Claims, 4 Drawing Figures

AUTOMATIC BARREL WINDING MECHANISM

BACKGROUND OF THE INVENTION

This invention relates to improvements in and relating to automatic winding watches with a unidirectionally operating barrel-winding weight mass.

DESCRIPTION OF THE PRIOR ART

The touchless age has governed also the field of watches and for this purpose, electronic watches are gradually prevailing more and more among watch consumers. However, much is desired not only in a trouble-free reliance and in a cheap price requirement. Therefore, at least nowadays, automatic winding mechanical watches have a substantial share in the commercialized watches.

Various efforts are therefore being directed towards refined design, price reduction and improved high performance of the mechanical watches.

As for the automatic barrel winding system, Wm. P. Roseman disclosed in "The Swiss Watch", page 6, of March, 1971-issue that the unidirectional automatic winding system is more advantageous than the two-directional winding system.

Those skilled in the art have believed that the unidirectional automatic winding system represents only a half or so winding capacity in comparison with that of the two-directional automatic winding system, substantially based upon test results on the cyclotesting machine on which the watch under test is subjected to planetary motion. It is, however, rather advantageous if the mechanical watch could be fitted with an improved unidirectional automatic winding mechanism which provides generally rather higher operational efficiency with more simplified design than the two-directional one.

OBJECTS AND SUMMARY OF THE INVENTION

It is an object of the invention to provide an improved mechanical watch having a substantially simplified, yet more efficient automatic barrel winding mechanism.

A further object is to provide an improved thinner mechanical watch having a volumetrically reduced automatic winding mechanism.

These and further objects, features and advantages of the invention will appear more apparent as the description proceeds with reference to the accompanying drawings.

DETAILED DESCRIPTION OF THE INVENTION

Figure 1:
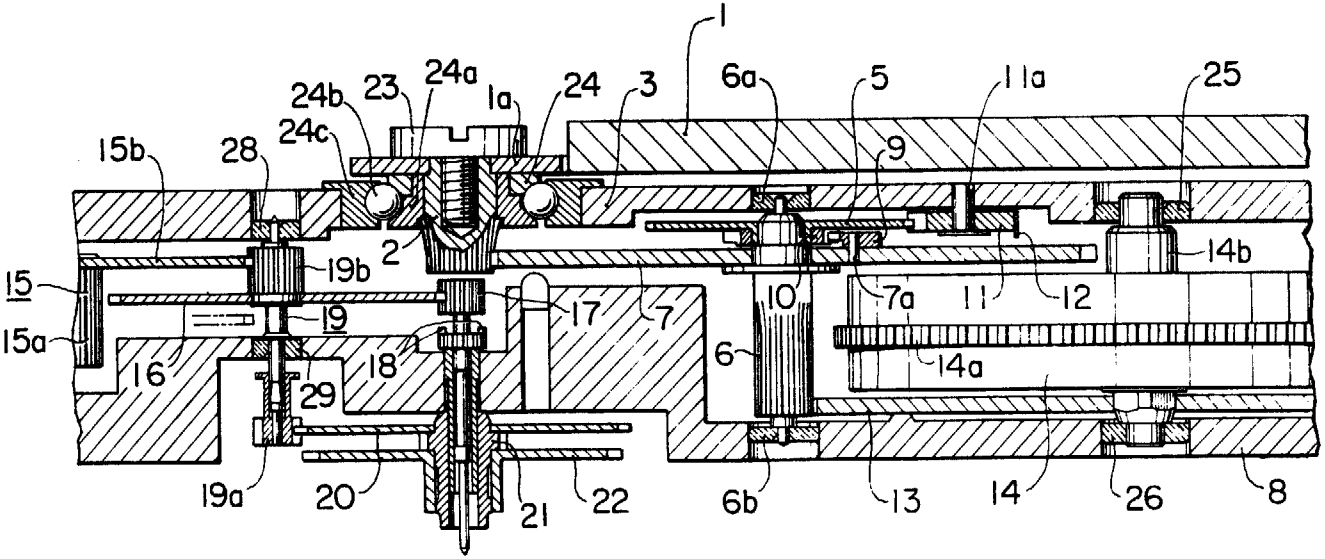
FIG. 1 is a sectional elevation of essential parts of a preferred embodiment of a mechanical watch representing the improved principles of the present invention, taken substantially along a section line I – I' shown in FIG. 2.

Referring now to FIG. 1, numeral 1 represents a conventional barrel-spring wind-up eccentric weight mass which is shown only partially. This weight mass 1 is formed integrally at its inner end with a hub 1*a* attached fixedly, yet detachably to a first pinion member 2 by means of a fixing screw 23 for unitary rotation with the pinion.

The first pinion member 2 is formed on its peripheral surface and substantially at its lower half portion with pinion teeth as shown, while its upper half portion is formed into a plain and rigid cylinder which is fixed in an inner race 24*a* of a ball bearing unit 24 by a press fit or like conventional fixing procedure. The inner race 24*a* cooperates, through a plurality of bearing balls 24*b* and a conventional cage, not shown, with an outer race 24*c* of the bearing unit, with the outer race being fixedly mounted in a conventional bridge, preferably a barrel bridge 3 by a press fit or like conventional fixing procedure. If necessary, a pillar plate 8 to be described may serve in place of the bridge 3.

The first pinion 2 meshes with a conventional clutch wheel 7 which is rotatably mounted on the stem of a second or clutch pinion 6 mounted in turn rotatably at both ends in bearing jewels 6*a* and 6*b* by and between the bridge 3 and the conventional pillar plate 8 respectively. A first and larger ratchet wheel 5 is fixedly mounted on the arbor of the clutch pinion 6. In the same way, a second and smaller ratchet wheel 10 is also fixedly mounted on the arbor of the clutch pinion 6.

The clutch wheel 7 mounts fixedly a pin 7*a* on which a first clutch pawl 9 is pivotably mounted and kept in mesh with the second and smaller ratchet wheel 10.

It will be seen from the foregoing that motion can be transmitted in one direction only from the first pinion 2 through clutch wheel 7, ratchet pawl 9 and ratchet wheel 10 to the arbor of clutch pinion 6 which is thus rotated correspondingly. This motion-transmitting direction is such that the clutch wheel 7 is caused to rotate in a counter clockwise direction when seen in FIG. 2.

Figure 2:
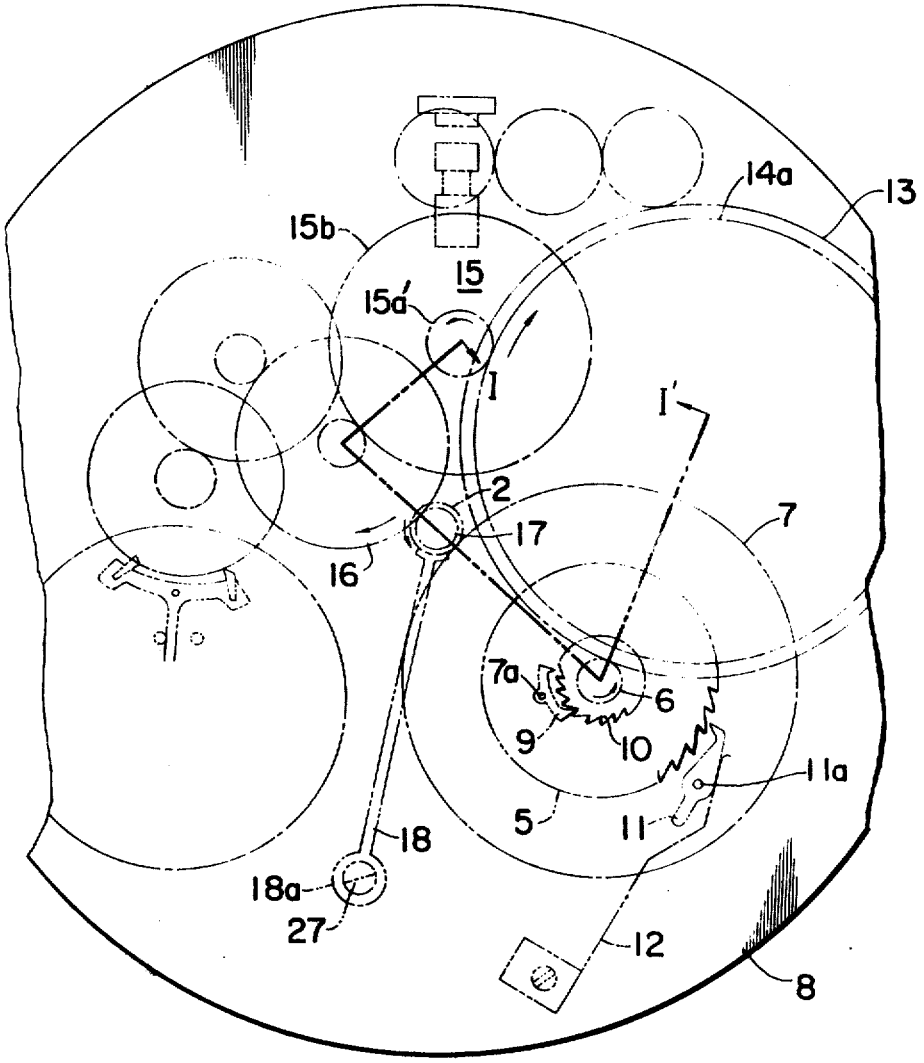
FIG. 2 is a schematic plan view of a combined time-keeping and barrel-winding gear train employed in the improved watch according to this invention, drawn on a slightly reduced scale in comparison with FIG. 1, wherein the constituent gears and the like are drawn by their respective pitch lines only for simplicity.

The first ratchet wheel 5 cooperates a ratchet pawl or click 11 which is pivotably mounted on a pin 11*a* fixedly depending from the bridge 3 when seen in FIG. 1, with the ratchet pawl 11 being backed-up by a spring strip 12 as clearly seen in FIG. 2 and a root portion of the spring strip is fixedly mounted on the same bridge 3. Clutch pinion 6 meshes with a conventional winding gear wheel 13, as seen in FIGS. 1 and 2.

Numeral 14 represents a barrel which is provided with an integral and concentric gear 14*a* and a conventional barrel arbor 14*b* which is rotatably mounted at both ends by means of jewels 25 and 26 mounted fixedly in the bridge 3 and pillar plate 8, respectively. Although not shown, the barrel spring is attached at one end to and mounted on the arbor 14*b*. The barrel gear 14*a* meshes with the pinion at 15*a* of a second wheel 15, as shown in FIG. 2. Motion can be transmitted therefrom through a second gear 15*b* and third wheel 16 to a seconds hand pinion 17, as conventionally.

Numeral 18 represents a friction spring, with a root portion 18*a* being fixedly mounted on the pillar plate 8 by means of a set screw 27, while the free end of the spring 18 is kept in frictional contact with the seconds hand pinion 17 for suppression of an otherwise possible fluctuating motion thereof.

Numeral 19 represents a third pinion assembly rotatably mounted by and between the bridge 3 and pillar plate 8 by means of jewels 28 and 29 lower pinion 19*a* and an upper pinion 19*b*, as shown in FIG. 1. The lower pinion 19*a* is attached to the assembly 19 frictionally. For performing a slip motion when transmitted time-setting torque thereto, the pinion 19*a* meshes with a conventional cannon gear 20 which is attached to and frictionally mounted on a cannon pinion 21. Numeral 22 represents a conventional hour wheel rotatably mounted on the cannon pinion 21. The third gear 16 is fixedly mounted on the pinion assembly 19.

From the foregoing, it will be clear that the automatic winding gear train according to this invention represents a two-stage reduction, or more specifically at between 2 and 7 and between 6 and 13, respectively. Therefore, it represents a highly simplified structure.

Figure 3:
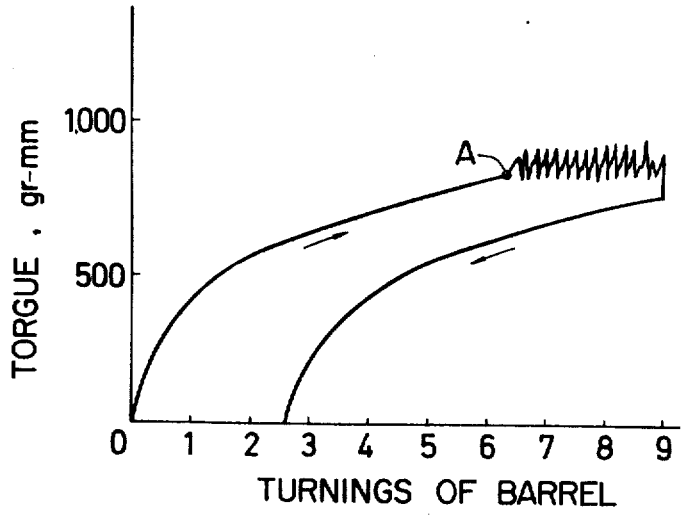
FIG. 3 is a first chart of the barrel torque plotted against the turned number of revolutions of a power spring barrel.

In the commonly used bidirectional barrel winding-up system, the overall reduction ratio of the automatic winding gear train is generally taken from 1/120 to 1/200. On the other hand, the winding torque ratio is generally taken as 1.2 – 2.5. The term "winding torque ratio" means such ratio by dividing the gravity torque at the automatic winding eccentric mass as at 1 in FIG. 1 by the overall reduction ratio and multiplying the overall mechanical efficiency, for instance 0.77 of the barrel winding gear train and further divided by the maximum torque at the barrel spring, with the latter torque being measured at a certain predetermined point "A" shown in FIG. 3. The point "A" corresponds to such that where the barrel spring shows its practically maximum winding-up torque. Thus, the ratio represents conventionally a certain multiple factor of the maximum barrel spring torque as measured at the point "A" relative to the practical torque applied from the eccentric mass through the winding gear train onto the barrel spring.

In the unidirectional barrel winding system, the reduction ratio has been generally designed also within the range of 1/120 – 1/200. In a similar way, the winding-up ratio has generally been designed to be 1.2 – 2.5 also in this case. According to our practical measurements, practically commercialized watches fall into these design ranges.

It has been definitely convinced by those skilled in the art that the barrel spring can not be effectively wound, when the winding torque ratio is not enough larger than unity. We have found, according to our own experimental results, that the barrel spring can be well wound when the barrel winding system is of the unidirectional type and the winding torque ratio is designed to unity or even less substantially than unity.

Figure 4:
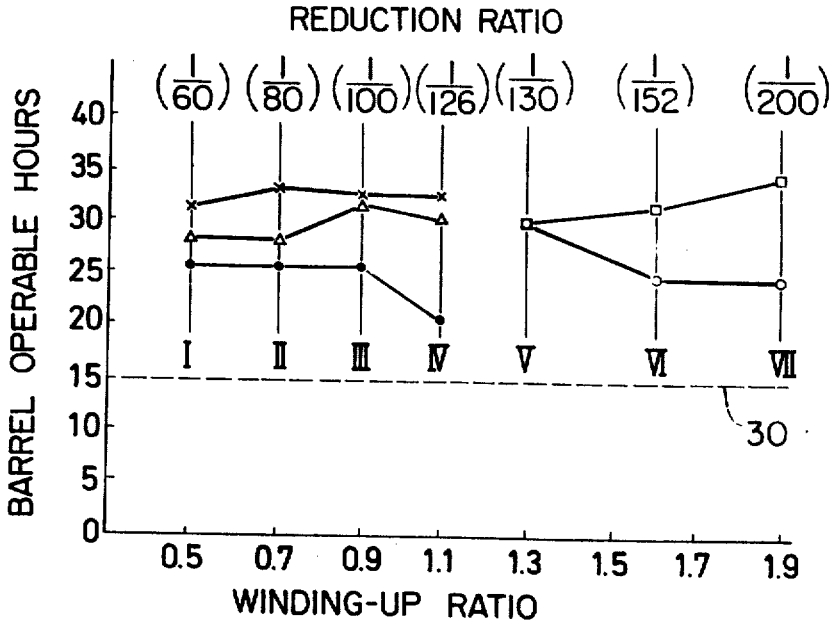
FIG. 4 is a second chart of the barrel energy hours plotted against the wind-up ratio.

Several experimental results are shown by way of example in FIG. 4, wherein the workable hours of the barrel spring have been plotted against the wind-up ratio of the above kind.

In the first four cases I, II, III and IV, four different watches were used which represent four different reduction ratios of 1/60. 1/80, 1/100 and 1/126 and four different winding-up ratios of 0.5; 0.7; 0.9 and 1.1, respectively. In each of these cases, three different persons who were business employees and had rather little control of their physical movements, carried personally each of these watches for one month. Every person carried the watch from 8h-0-0 to 18h-0-0 in the mean on each day. At every morning before wearing, the barrel of the watch had preserved a charged energy for 18h-workability and when he came back to home, the remaining and recharged amount of the accumulated spring energy was measured. These three persons are identified in FIG. 4 by small crosses, small triangles and small black dots, respectively. The results in each case are shown by the mean value measured and calculated for one month. As seen from the results in these cases I, II, III and IV, the unidirectional barrel winding-up system having these different design data of the reduction ratio and barrel winding-up ratio had served well for the desired service, because in each case, the remained and recharged barrel spring energy was substantially higher than the critical level, shown by a dotted horizontal line 30, necessary for safety drive of the watch movement.

In the second experimental group consisting of three different cases V, VI and VII, similar experiments were carried out on three different watch movements carried by two other persons who are identified by small blank squares and small blank dots, respectively. The unidirectional barrel wind-up systems of these watches had three different reduction ratios: 1/130; 1/150 and 1/200 and three different winding-up ratios: 1.3; 1.6 and 1.9, respectively. The results were only slightly improved from those of the first group of the cases I – IV, but in compensation of rather and substantially complicated structure of the barrel winding system, as being acknowledged by the substantially higher reduction rates as well as substantially higher barrel winding-up ratios. Therefore, these conventional designs have been discarded in the present invention.

In fact, the structure shown and described in the foregoing in connection with FIG. 1 has been adopted by review of these experimental results of the first group shown in FIG. 4.

The embodiments of the invention in which an exclusive property or privilege is claimed are as follows:

1. In an automatic barrel winding mechanism of a watch movement, comprising: a rigid frame; a member preferably a barrel bridge or pillar plate provided for the rigid frame; a winding eccentric mass pivotably mounted on said member; a pinion member rigidly connected with said eccentric mass for unitary rotation therewith; a barrel including a power spring; and a reduction gear train including a winding gear wheel which cooperates with said barrel, and a second gear means in mesh with the winding gear wheel and the pinion member, the improvement that means allowing the second gear means to rotate exclusively only in the barrel winding direction is provided, said means including a pawl mounted on said member, a ratchet wheel integral with the second gear means, and a spring mounted on said member for resiliently urging the pawl towards the ratchet wheel in which the winding torque ratio of said mechanism is 0.5 – 1.1.

2. In an automatic barrel winding mechanism of a watch movement, a movement frame, a barrel having a power spring rotatably mounted in the frame, an automatic winding weight mass rotatably mounted on the frame, a first pinion rigidly connected to the winding weight mass for rotation therewith, a winding gear wheel rotatably mounted in the frame and cooperable with the barrel, a second pinion rotatably mounted in the frame and maintained in direct mesh with the winding gear wheel, a second gear wheel rotatably mounted on the second pinion, the second gear wheel being maintained in direct mesh with the first pinion, the first pinion and second gear wheel constituting a first stage reduction and the second pinion and winding gear wheel constituting a second stage reduction, first means mounted on the frame and operably related to the second pinion allowing the second pinion to rotate exclusively only in the barrel winding direction, and second means operably related to the second pinion for transmitting torque exclusively only in the barrel winding direction.

3. The automatic barrel winding mechanism as claimed in claim 2, in which the first means includes a pawl mounted on the frame, a ratchet wheel integral with the second pinion and a spring mounted on the frame for resiliently urging the pawl towards the ratchet wheel.

* * * * *